United States Patent [19]

Tabereaux

[11] Patent Number: 4,498,966

[45] Date of Patent: Feb. 12, 1985

[54] ALUMINA REDUCTION CELL

[75] Inventor: Alton T. Tabereaux, Sheffield, Ala.

[73] Assignee: Reynolds Metals Company, Richmond, Va.

[21] Appl. No.: 607,744

[22] Filed: May 7, 1984

[51] Int. Cl.[3] ..... C25B 9/00

[52] U.S. Cl. ..... 204/243 R

[58] Field of Search ..... 204/243 R, 67

[56] References Cited

U.S. PATENT DOCUMENTS

| | | | |
|---|---|---|---|
| 4,224,128 | 9/1980 | Walton | 204/243 R |
| 4,349,427 | 9/1982 | Goodnow et al. | 204/243 R |
| 4,383,910 | 5/1983 | Richards | 204/243 R |
| 4,396,481 | 8/1983 | Pawlek et al. | 204/243 R |
| 4,396,482 | 8/1983 | Das et al. | 204/243 R |
| 4,410,403 | 10/1983 | Jacobs et al. | 204/67 |
| 4,443,313 | 4/1984 | Gesing et al. | 204/243 R |

*Primary Examiner*—R. L. Andrews

*Attorney, Agent, or Firm*—Alan T. McDonald

[57] ABSTRACT

An alumina reduction cell is described in which a bed of holow refractory hard metal (RHM) shapes form a packed cathode bed above the carbonaceous cell cathode and within the molten aluminum pad. This packed bed permits free flow of the molten aluminum and reduces RHM material usage as compared to known packed bed cells.

6 Claims, 1 Drawing Figure

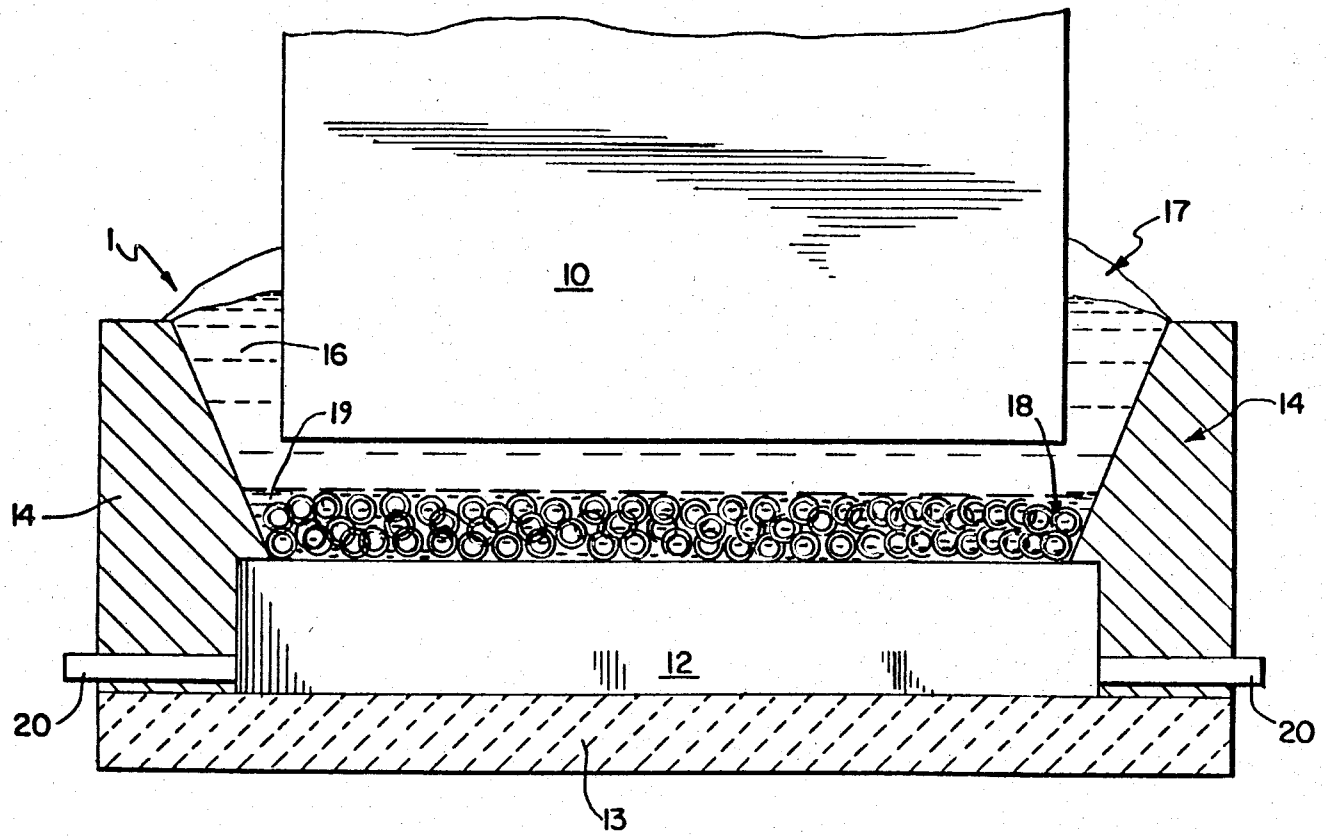
14
17
16
1
10
19
18
12
14
20
13
20

ALUMINA REDUCTION CELL

BACKGROUND OF THE INVENTION

Aluminum metal is conventionally produced by the electrolytic reduction of alumina dissolved in a molten cryolite bath according to Hall-Heroult process.

This process for reducing alumina is carried out in a thermally insulated cell or "pot" which contains the alumina-cryolite bath. The cell floor, typically made of a carbonaceous material, overlies some of the thermal insulation for the cell and serves as a part of the cathode. The cell floor may be made up of a number of carbonaceous blocks bonded together with a carbonaceous cement, or it may be formed using a rammed mixture of finely ground carbonaceous material and pitch. The anode, which usually comprises one or more carbonaceous blocks, is suspended above the cell floor. Resting on the cell floor is a layer or "pad" of molten aluminum which the bath sees as the true cathode. The anode, which projects down into the bath, is normally spaced from the pad at a distance of about 1.5 to 3.0 inches (3.81 to 7.61 centimeters). The alumina-cryolite bath is maintained on top of the pad at a depth of about 6.0 to 12.0 inches (15.24 to 30.48 centimeters).

As the bath is traversed by electric current, alumina is reduced to aluminum at the cathode and carbon is oxidized to its dioxide at the anode. The aluminum thus produced is deposited on the pad and tapped off periodically after it has accumulated.

For the electrolytic process to proceed efficiently, the alumina reduction should occur onto a cathode surface of aluminum and not the bare carbonaceous surface of the cell floor. Therefore, it is considered important for the pad to cover the cell floor completely.

As molten aluminum does not readily wet or spread thinly on carbonaceous materials, the pad can best be visualized as a massive globule on the cell floor. In larger cells, the dense currents of electrolysis give rise to powerful magnetic fields, sometimes causing the pad to be violently stirred and to be piled up in selected areas within the cell. Therefore, the pad must be thick enough so that its movements do not expose the bare surface of the cell floor. Additionally, the anode must be sufficiently spaced from the pad to avoid short circuiting and to minimize reoxidation of aluminum.

Still, the movements of the pad have adverse effects which cannot always be readily controlled. For a given cell operating with a particular current of electrolysis, there is an ideal working distance between the cathode and the anode for which the process will be most energy efficient. However, the required spacing of the anode due to turbulence of the pad prevents this ideal working distance from being constantly maintained. Further, since the pad is in a state of movement, a variable, nonuniform working distance is presented. This varible interelectrode distance can cause uneven wear or consumption of the anode. Pad turbulence can also cause an increase in back reaction or reoxidation at the anode of cathodic products, which lowers cell efficiency. In addition, pad turbulence leads to accelerated bottom liner distortion and degradation through thermal effects and through penetration by the cryolite and its constitutents.

It has been suggested in the literature and prior patents that certain special materials such as refractory hard metals (RHM), most notably titanium diboride ($TiB_2$) or its homologs, can be used advantageously in forming the cell floor. Further, it has been found that RHM tile materials may be embedded into the cell floor, rising vertically through the molten aluminum layer and into the cryolite-alumina bath, with the uppermost ends of these tiles forming the true cathode. When such a cathode design is employed, precise spacing between the true or active surfaces of the cathode and the anode may be maintained, since such a system is not affected by the ever-moving molten aluminum pad acting as the true cathode surface.

Ideally, in contrast to conventional carbon products, these RHM materials are chemically compatibile with the electrolytic bath at the high temperatures of cell operation and are also comparable chemically with molten aluminum.

Furthermore, the special cell floor materials are wetted by molten aluminum. Accordingly, the usual thick metal pad should no longer be required, and molten aluminum may be maintained on the cell floor as a relatively thin layer and commensurate with amounts accumulating between the normal tapping schedule.

With all their benefits to the reduction process, there are problems associated with the use of RHM tiles as vertically projecting members into the alumina-cryolite bath. When attached to carbonaceous substrates, such as the carbonaceous cathode of a reduction cell, erosion occurs at the RHM tile-carbonaceous substrate interface in the presence of molten aluminum and electrolyte. It is believed that this erosion is primarily chemical in nature, with the molten aluminum wetting the tile surface and reacting with the carbon to form $Al_4C_3$, which then dissolves in the electrolyte. This sets up a mechanism for removal of carbon from the tile interface and below, causing detachment of the cathodic tiles from the carbonaceous substrate.

Additionally, RHM tile materials are brittle and subject to breakage during the normal working operations performed on a reduction cell. As an increasing number of tiles are broken, the true cathode again becomes an uneven surface. However, due to the presence of the unbroken tiles, it is impossible to adjust the anode to form an even surface.

Recently, it has been proposed to replace the fixed RHM tiles with RHM pieces, with the pieces forming a packed bed on the carbonaceous cathode and within the aluminum pad. U.S. Pat. Nos. 4,396,481 and 4,410,403 and International Application No. PCT/US/81/00067 describe such a cell construction. These are, however, problems associated with this approach.

First, the packing density of RHM pieces is quite high, being in the order of about 150 to 250 pounds per cubic foot. Thus, for example, a reduction cell having a nominal 52 cubic foot volume aluminum metal pad could require over 10,000 pounds of such pieces. RHM material is quite expensive, thus, the high cost of packing a cell with RHM pieces is difficult to cost justify.

The high density of RHM pieces when in a packed bed also creates operational difficulties. An equal volume of aluminum metal is displaced from the metal pad by the packed bed of RHM material. In the 52 cubic foot aluminum pad example given above, a packed bed of RHM pieces could displace almost 37 cubic feet of aluminum metal, or over 70% of the aluminum volume.

The limited volume available for aluminum metal in the cathode cavity due to the high packing density of RHM pieces could cause rapid, high fluctuations of metal level in the cell, resulting in operational difficulties due to excessive anode adjustment, or shorting between the anode and the aluminum cathode, during metal production and/or metal taping operations. Further, the limited space between the RHM pieces, due to the high packing density of these pieces, results in reduced flowability of aluminum metal between the pieces. A gradual accumulation of sludge or muck in the packed bed results, due to natural occurrence of undissolved alumina, causing an increase in the electrical resistance of the cell and inefficient operation. Additionally, the current distribution in the packed bed becomes poor as a result of the increased resistance due to sludge accumulation. The uneven current distribution increases the metal movement and metal wave amplitude in the aluminum metal pad. As a result, the cell must be operated at a higher electrical energy consumption rate, and at an increased anode-cathode distance, due to the higher cathode resistance and metal pad movement.

It is desirable, therefore, to construct an alumina reduction cell which employes RHM materials, for their beneficial effects on cell production, but which eliminates the problems of both fixed tile breakage and packed bed inefficiencies.

THE PRESENT INVENTION

By means of the present invention, these desired results may be obtained.

The present invention comprises an alumina reduction cell having a packed RHM material bed lying on the floor of the carbonaceous cathode and within the molten aluminum pad. The RHM material forming this bed comprises hollow shapes, providing an increased level of interstices through which the molten aluminum may pass. Preferably, these RHM shapes are in the form of rings or hollow cylinders.

When employing the packed bed alumina reduction cell of the present invention, molten aluminum may readily flow within and between the RHM shapes, due to the substantially reduced pack density of the packed bed. This enables close control of the anode-cathode distance, eliminates concern for broken tiles, and reduces substantially the cost of the cell, both in operational and in construction costs, as opposed to the solid particle packed bed RHM cell.

BRIEF DESCRIPTION OF THE DRAWING

The alumina reduction cell of the present invention will be more fully described with reference to the drawing in which:

The FIGURE is a side elevational view of an alumina reduction cell, with the end wall removed, according to the practice of the present invention.

DETAILED DESCRIPTION OF THE PREFERRED EMBODIMENT

The FIGURE illustrates an alumina reduction cell 1 employing the present invention. Anode blocks 10, formed from a carbonaceous material, are suspended within a bath 16 of alumina dissolved in molten cryolite and are attached to a source of electrical current by means not shown. A crust 17 of frozen cryolite-alumina covers the bath 16. Carbonaceous cathode blocks 12 may be joined together by a rammed mixture of pitch and ground carbonaceous material or by means of a carbonaceous cement, by means well known to those skilled in the art. These cathode blocks 12 are connected by means of conductor bus bars 20 to the electrical current source to complete the electrical circuit. Outer walls 14 form the side and end supporting structures for the cell 1. The walls 14 may be formed, for example, from graphite blocks held together with a graphitic cement.

Lying on the carbonaceous cathode 12 and beneath the cryolite-alumina bath 16 is a pad 19 of molten aluminum. Within this pad 19 and lying on the upper surface of the cathode blocks 12 is a packed bed 18 of refractory hard metal (RHM) shapes. The RHM shapes may be formed of such materials as $TiB_2$, $TiB_2$-AlN mixtures, and other similar materials well known to those in the art, typically by hot pressing or sintering RHM powders to form the shapes. These refractory hard metal materials are wetted by molten aluminum, where the molten aluminum passes between and through these shapes, preventing individual globules of molten aluminum from forming at the interfaces between the molten aluminum and the RHM shapes and thereby reducing movement of the molten aluminum pad 19.

To minimize cracking during use of these shapes, due to the brittleness of the RHM materials, the RHM shapes 18 may be reinforced with carbon, graphite, or silicon carbide fibers or particles, which are added to the powders forming these shapes 18 prior to hot pressing or sintering. When fibers are employed, fibers may be random or uniform in length and are oriented in the plane perpendicular to the direction of hot pressing. The fibers or particles act to resist tensile stresses that could result in cracking during use. However, breakage of isolated hollow shapes 18 will not effect the cell operation measurably.

As previously mentioned, the refractory hard metal shapes 18 are hollow. In other words, each RHM shape 18 has an internal free space through which the molten aluminum of the pad 19 may pass. While the RHM shapes 18 may take many forms, it is preferred that the shapes form a packed density of between about 30 to 70 pounds per cubic foot, and have about 90% free space volume within the packed bed.

One particularly suitable shape for the RHM shapes 18 is a ring or hollow cylinder. For example, a cylindrical ring having an outside diameter ranging between about 1.0 and 4.0 inches, a wall thickness of between about 0.05 and 0.50 inches, and a height ranging between about 0.50 and 1.0 inches is an example of a suitable hollow shape for the RHM shapes 18 in the cell 1 of the present invention.

While the FIGURE illustrates the shapes 18 as being oriented along parallel axes, this is merely for purposes of illustration. The RHM shapes 18 are normally randomly oriented, as is typical in any packed bed operation.

When employing the packed bed of the present invention, the amount of RHM material needed per cell can be reduced by as much as 85% over that of a packed bed RHM cell using solid pieces. Thus, in the previous 52 cubic foot cell example, only approximately 1,560 pounds per cell of RHM hollow rings, providing a packed density of approximately 30 pounds per cubic foot, would be required. As a consequence of the reduced quantity of RHM material required per cell, it is much more economical to construct packed beds of hollow RHM shapes in industrial reduction cells.

Further, the quantity of aluminum metal displaced from the aluminum metal pad 19 is reduced by the same 85%, resulting in improved cell operation due to increased stability of aluminum metal fluctuation levels and improved control over alumina sludge deposits or accumulations in the packed bed, resulting from the increased aluminum metal flow between and among the RHM shapes.

From the foregoing, it is clear that the present invention provides a simple, yet effective, solution to the problems associated with the use of RHM materials in alumina reduction cells.

While presently preferred embodiments of the invention have been illustrated and described, it is clear that the invention may be otherwise variously embodied and practiced within the scope of the accompanying claims.

I claim:

1. In an alumina reduction cell having an anode, a carbonaceous cathode and a packed bed of refractory hard metal (RHM) pieces lying on and in contact with said carbonaceous cathode but not attached thereto and within a pad of molten aluminum the improvement wherein said RHM pieces are hollow shapes between which and through which said molten aluminum may pass.

2. The cell of claim 1 wherein said hollow RHM shapes have a packed bed density of between about 30 to 70 pounds per cubic foot and a free space volume of about 90%.

3. The cell of claim 1 wherein said hollow RHM shapes are in the form of rings.

4. The cell of claim 3 wherein said rings have an outside diameter of between about 1.0 to 4.0 inches, a wall thickness of between about 0.05 to 0.50 inches and a height of between about 0.50 to 1.0 inches.

5. The cell of claim 1 wherein said hollow RHM shapes are formed from a material selected from the group consisting of titanium diboride and titantium diboride-aluminum nitride mixtures.

6. The cell of claim 1 wherein said hollow RHM shapes are fiber reinforced.

* * * * *